US007204217B2

(12) United States Patent
Bilic et al.

(10) Patent No.: US 7,204,217 B2
(45) Date of Patent: Apr. 17, 2007

(54) HYDRAULIC CAMSHAFT ADJUSTER FOR A CAMSHAFT OF AN INTERNAL COMBUSTION ENGINE

(75) Inventors: Dzoni Bilic, Berlin (DE); Jens-Uwe Plank, Berlin (DE)

(73) Assignee: DaimlerChrysler AG, Stuttgart (DE)

( * ) Notice: Subject to any disclaimer, the term of this patent is extended or adjusted under 35 U.S.C. 154(b) by 31 days.

(21) Appl. No.: 11/249,011

(22) Filed: Oct. 12, 2005

(65) Prior Publication Data

US 2006/0081204 A1 Apr. 20, 2006

(30) Foreign Application Priority Data

Oct. 15, 2004 (DE) ..... 10 2004 050 236
Oct. 15, 2004 (DE) ..... P806092/US/1

(51) Int. Cl.
*F01L 1/34* (2006.01)

(52) U.S. Cl. ..... 123/90.17; 123/90.15; 123/90.31; 92/5 L; 92/120; 92/122; 464/2; 464/160

(58) Field of Classification Search ..... 123/90.17
See application file for complete search history.

(56) References Cited

U.S. PATENT DOCUMENTS 6,311,657 B2 * 11/2001 Sugawara et al. ..... 123/90.17
6,334,414 B1 * 1/2002 Okada et al. ..... 123/90.15
6,739,298 B2 * 5/2004 Kusano et al. ..... 123/90.17

FOREIGN PATENT DOCUMENTS

DE 102 53 496 9/2003

* cited by examiner

*Primary Examiner*—Thomas Denion
*Assistant Examiner*—Kyle M. Riddle
(74) *Attorney, Agent, or Firm*—Klaus J. Bach

(57) ABSTRACT

In a hydraulic camshaft adjuster for a camshaft of an internal combustion engine, with an inner body connected for rotation with the camshaft and having at least one vane extending into a chamber formed in an outer body mounted rotatably relative to the camshaft and connected for rotation with a crankshaft for driving the camshaft and with a hydraulic control mechanism for adjusting the relative angular position between the inner and the outer bodies and including a locking structure for selectively locking and releasing the inner body with respect to the outer body, at least one bolt is slidably supported in an opening in the inner body so as to be movable into a guide slot in the outer body by the force of an axially acting spring element, said bolt when released from the guide slot against the axially acting spring force by the pressure force of a hydraulic operating fluid being retainable laterally displaced out of alignment with the guide slot by centrifugal forces against the force of a radially acting spring.

14 Claims, 2 Drawing Sheets

HYDRAULIC CAMSHAFT ADJUSTER FOR A CAMSHAFT OF AN INTERNAL COMBUSTION ENGINE

BACKGROUND OF THE INVENTION

The invention relates to a hydraulic camshaft adjuster for a camshaft of an internal combustion engine with a hydraulic operating mechanism for adjusting the angular position of the camshaft relative to the crankshaft.

To lower fuel consumption and untreated emissions and to increase power and torque, many gasoline engines are equipped with camshaft adjusters. These vary the phase position of the camshaft in relation to the crankshaft. Hydraulic vane-cell adjusters are mostly used at the present time, which have an outer body connected for rotation with a driving wheel and an inner body rotatably disposed in the outer body and connected for rotation with the camshaft. The outer body has at least one hydraulic chamber and the inner body has at least one pivot vane which divides the hydraulic chamber into two working chambers. Adjustment is carried out by means of a controlled supply of oil from the engine circuit into the respective working chamber via a control valve. The control valve is operated by means of an electromagnetic device. Since, when the internal combustion engine is operating, the pivot vane of the inner body is subjected to the changing moments of the camshaft, it is necessary at operating times when there is still no oil pressure present at the camshaft adjuster, such as, for example, during starting of the internal combustion engine, or the oil pressure level is too low for the adjusting operation, to provide a locked basic and emergency operative position by means of a corresponding mechanism. Consequently, at these operating points, undefined control time changes due to the oscillation of the pivoting vane with respect to the housing must be prevented and noises resulting therefrom should be minimized.

DE 102 53 496 A1 discloses a generic camshaft adjuster for adjusting the rotary angle of the camshaft with respect to a crankshaft of an internal combustion engine. The camshaft adjuster has an outer body connected fixedly in terms of rotation to a driving wheel and an inner body connected fixedly in terms of rotation to the camshaft, the outer body having at least one hydraulic chamber and the inner body at least one pivoting vane which divides the hydraulic chamber into two working chambers. The pivoting vane is pivotable hydraulically between a late stop and an early stop by means of a controlled oil pressure and, in its middle position between the two stops, has the basic position which can be locked by means of two spring-loaded and hydraulically releasable locking bolts which for locking engage in each case into a locking groove/bore. The locking bolts prevent an unwanted movement of the camshaft adjuster when there is no oil pressure present.

In hydraulically operated camshaft adjusters which are not to maintain their locked basic position of the mechanical stops for limiting the adjustment range, but, instead, in a defined intermediate position within this range, there is the problem that, when the internal combustion engine is in controlled operation, the pivoting vane or the hub of the inner body must move over the locking base position, without the movement of the pivoting vane being impeded by an undesirable engagement of the locking bolt which may be triggered, in particular, by fluctuations of the oil pressure from the oil supply or a brief undershooting of pressure due to oscillations of the inner body with respect to the outer body.

It is the object of the present invention, therefore, to provide a hydraulic camshaft adjuster in such a way that a reliable release of the camshaft adjuster lock and a reliable disengagement state can be achieved.

SUMMARY OF THE INVENTION

In a hydraulic camshaft adjuster for a camshaft of an internal combustion engine, with an inner body connected for rotation with the camshaft and having at least one vane extending into a chamber formed in an outer body mounted rotatably relative to the camshaft and connected for rotation with a crankshaft for driving the camshaft and with a hydraulic control mechanism for adjusting the relative angular position between the inner and the outer bodies and including a locking structure for selectively locking and releasing the inner body with respect to the outer body, at least one bolt is slidably supported in an opening in the inner body so as to be movable into a guide slot in the outer body by the force of an axially acting spring element, said bolt when released from the guide slot against the axially acting spring force by the pressure force of a hydraulic operating fluid being retainable laterally displaced out of alignment with the guide slot by centrifugal forces acting against the force of a radially acting spring.

An essential advantage of the camshaft adjuster according to the invention is the increased operating reliability of the camshaft adjuster, in that the bolt has a release position largely independent of hydraulic medium pressure and of leakage. Advantageously, this position of the bolt which is independent of hydraulic medium pressure and of leakage is achieved by means of a simple configuration of the hydraulically loadable mechanism, in that the mechanism additionally has a radially acting spring element and a clearance in the guide of the inner body.

The invention will become more readily apparent from the following description of an exemplary embodiment thereof with reference to the accompanying drawings:

DESCRIPTION OF A PREFERRED EMBODIMENT

For the sake of simplicity, the same reference symbols are used for identical components in the various figures.

Figure 1:
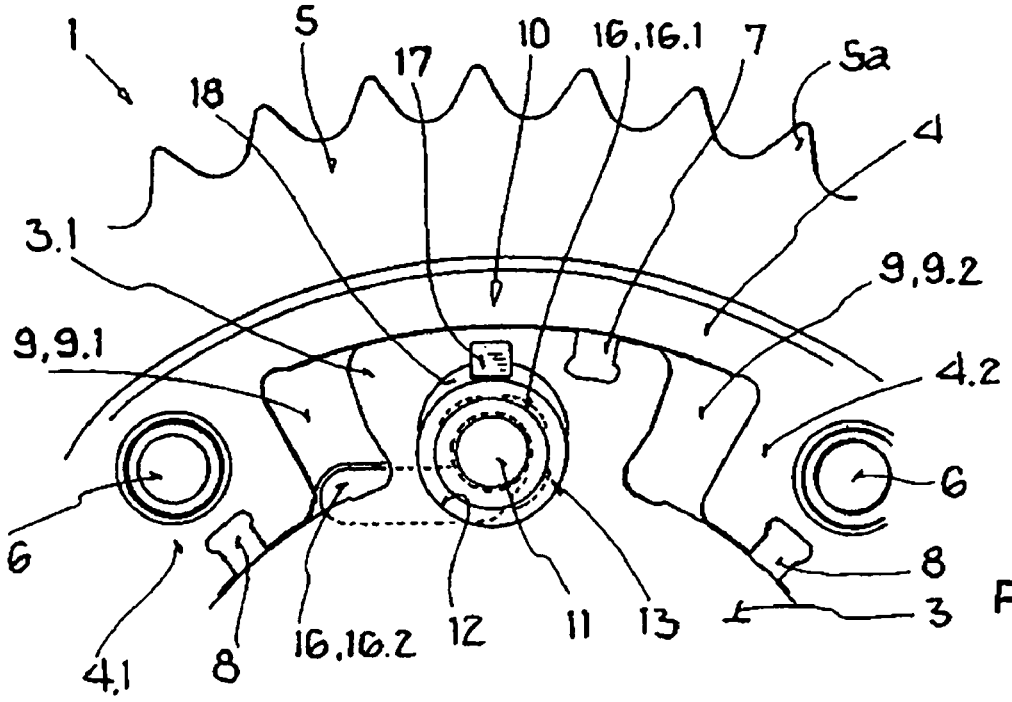
FIG. 1 shows a top part of a hydraulic camshaft adjuster in the locked position in a housing with a cover which has been removed, the camshaft adjuster having a hydraulically actuated mechanism for locking and releasing the hydraulic camshaft adjuster comprising a locking bolt guided in an inner body of the camshaft adjuster, a guide slot formed in the housing and with a radial spring element engaging the locking bolt.
Figure 2:
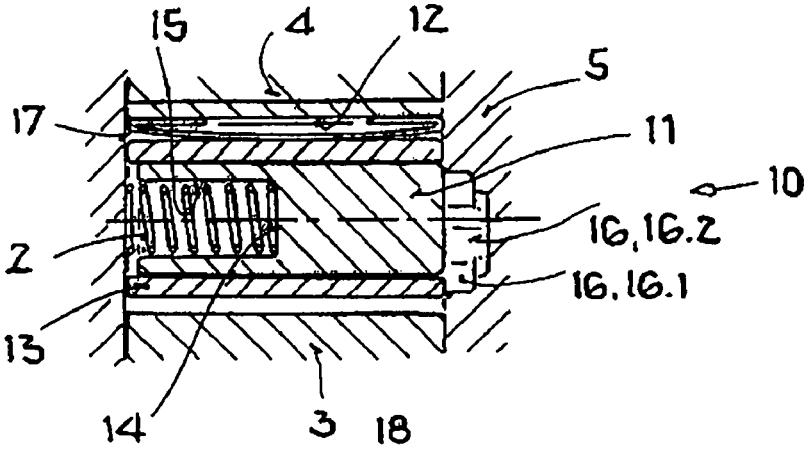
FIG. 2 shows a section through the hydraulically actuated mechanism of the camshaft adjuster in the released position, with a clearance provided in the inner body for the radial displacement of the bolt.
Figure 3:
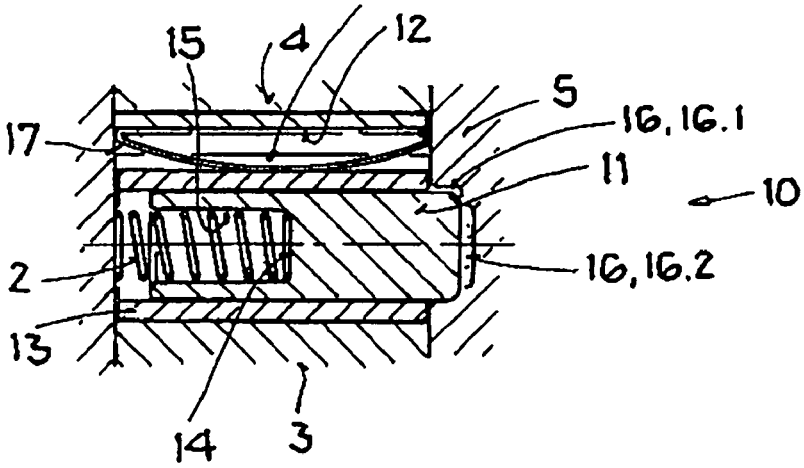
FIG. 3 shows a section through the hydraulically activated mechanism in the locking position.

FIGS. 1 to 3 show a detail of a hydraulic camshaft adjuster 1 for adjusting a camshaft, which cannot be seen here, with respect to a crankshaft, not illustrated, of an internal combustion engine. The camshaft adjuster 1 has two transmission parts 3, 4 rotatable relative to one another for adjustment, that is an inner body 3 connected for rotation with the camshaft and an outer body 4 mounted rotatably with respect to the camshaft and connected for example to the crankshaft of an engine for rotation therewith. The transmission parts 3, 4 are arranged between two covers 5, only one of which is illustrated in the figures. The outer body 4 is connected fixedly in terms of rotation to the cover 5. In the present exemplary embodiment, the cover 5 is designed as a driving wheel. Furthermore, the cover 5 may also be connected fixedly to a separate driving wheel. The driving wheel 5 has on its outer circumference toothings 5*a* either produced in one piece with the driving wheel 5 or separately and connected fixedly to the driving wheel 5, via which toothings the camshaft is driven by the crankshaft of the internal combustion engine via a drive chain for example. Alternatively to this, the toothings may also be arranged directly on the outer body 4. The sprocket wheel drive indicated and referred to here may, of course, be replaced by other drive connections, such as, for example, toothed belt drives or gear drives.

Figure 4:
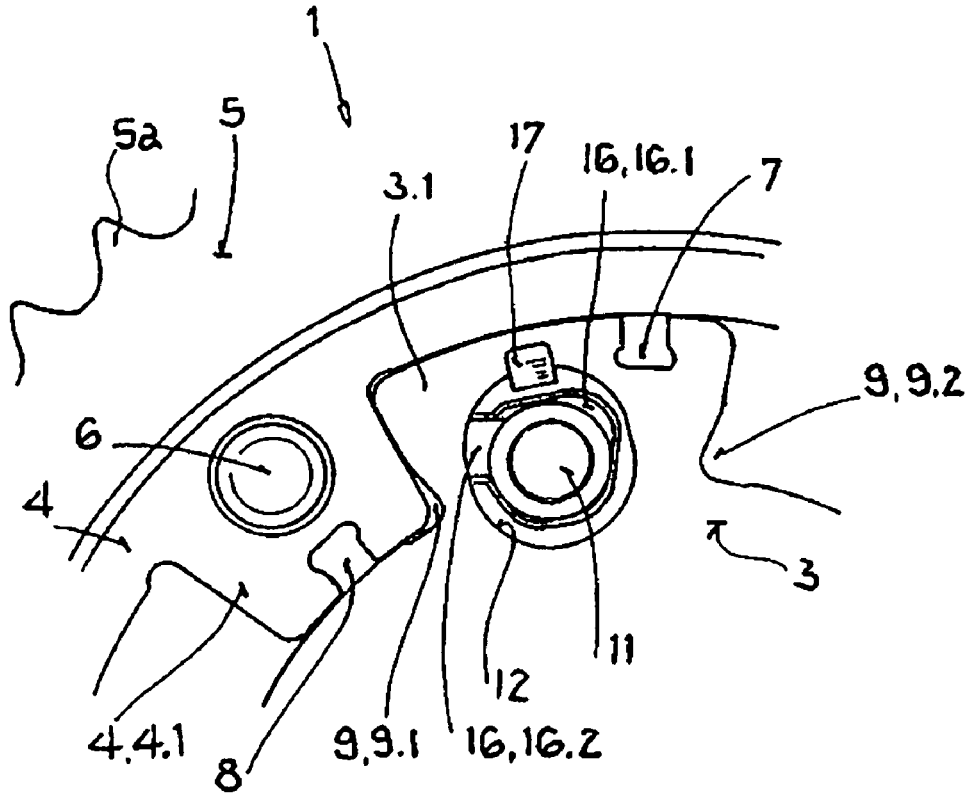
FIG. 4 shows a top part of the hydraulically actuated mechanism with a guide slot which narrows in the direction toward the center of rotation of the camshaft adjuster.
Figure 5:
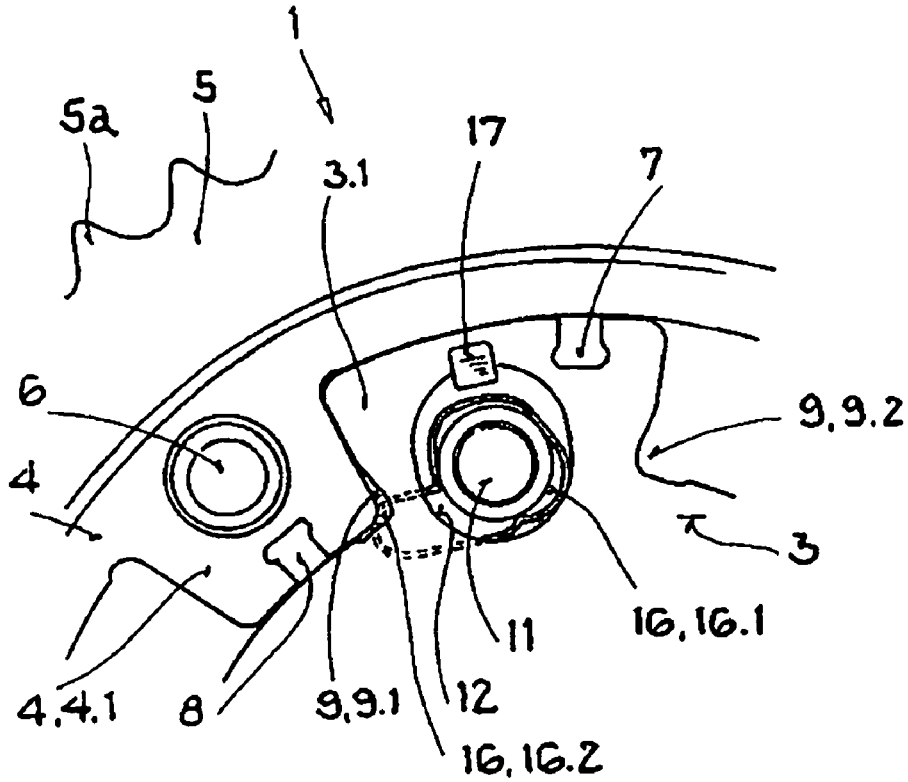
FIG. 5 shows a top part the hydraulically actuation mechanism with a guide slot which narrows radially outward.

According to FIGS. 1, 4 and 5, the sleeve-shaped outer body 4 surrounding the camshaft has inwardly projecting vanes 4.1, 4.2 which have bores 6 for receiving fastening screws, not illustrated here. The inner body 3 mounted fixedly in terms of rotation on the camshaft has outwardly projecting pivotable counter-vanes 3.1. Both the vanes 4.1, 4.2 of the outer body 4 and the vanes 3.1 of the inner body 3 have on their circumferences in each case at least one recess 7, 8 for receiving a seal, although the recesses together with the seals may, of course, also be located on the inner body 3 and/or on the outer body 4. The inner body 3 and outer body 4 form, together with the two covers 5, at least one hydraulic fluid chamber 9 which is divided into two operating chambers 9.1, 9.2 by the respective countervane 3.1. Of the operating chamber 9.1 only a gap can be seen in FIG*s*. 4 and 5.

So that the drive torque of the crankshaft can be transmitted to the camshaft, as already mentioned, the inner body 3 of the camshaft adjuster 1 is connected fixedly in terms of rotation to the camshaft. The drive torque is introduced into the camshaft adjuster 1 by the outer body 4 and is transmitted to the inner body 3 via the working chambers 9.1, 9.2 filled with the hydraulic fluid. By varying the filling of the operating chambers 9.1, 9.2 to varying degrees with hydraulic fluid, the phase position between the outer body 4 of the camshaft adjuster 1 and the camshaft can be changed. A control valve, not illustrated here, controls the supply of hydraulic fluid to the camshaft adjuster 1 and consequently the phase position or the change of the latter.

The camshaft adjuster 1 has a hydraulically loadable mechanism 10 for locking and releasing the inner and outer bodies 3 and 4 consisting of a bolt 11 and of an axially acting spring element 2, the mechanism 10 providing a fixed connection between the inner body 3 and the housing 4 as a result of an axial movement of the bolt 11. The numeral 12 designates a preferably continuous bolt guide opening 12 which, in turn, is preferably arranged in a vane 3.1 of the inner body 3, and in which the bolt 11 together with the axially acting spring element 2 is supported, the spring element preferably being a compression leaf spring. In the present exemplary embodiment, the bolt 11 is slidably supported in a sleeve 13 which is guided in the bolt guide opening 12 and which can be displaced radially together with the bolt 11.

In the present exemplary embodiment, according to FIG. 2, the bolt 11 is of cup-like design and receives within, at least partially, the compression spring 2, the spring 2 being supported on one side on the cover, not illustrated, of the camshaft adjuster 1 and, on the other side, on a bottom 14 of the cup-like recess 15 in the bolt 11. If the bolt is designed without a cup-like receptacle for the compression spring 2, the spring 2 is supported, on one side, on the cover of the camshaft adjuster 1 and, on the other side, on that end face of the bolt 11 which faces the spring 2.

The cover 5, designed as a driving wheel, includes a slot or groove 16, into which the bolt 11 projects in the locked state of the camshaft adjuster 1 as shown in FIGS. 1 and 3 to 5. The slotted part 16 is only partially visible in FIGS. 1, 4 and 5 owing to the components 3, 13 and 11 arranged above it. It is partially illustrated therefore by broken lines. In the present exemplary embodiment, the slotted part 16 is formed in the cover 5, that is to say it is produced in one piece with the cover 5. It may, however, also be produced as a separate part which is connected fixedly to the cover 5. The slotted part 16 has a cross-section 16.1 for receiving the bolt 11 and a cross-section 16.2 designed as a release duct. For release according to FIG. 2, that is to say to loosen the fixed connection between the inner body 3 and outer body 4, the bolt 11 is biased by the pressure fluid in a controlled manner via the release duct 16.2 against the force of the compression spring 2 out of its locking engagement so that adjustment movements are enabled.

In hydraulic camshaft adjusters 1 which do not have their locking position at a mechanical stop 3.1 and 4.1 or 4.2, but, instead, in a free intermediate position, there is the problem that, when the engine is in a controlled operation, the inner body 3 must be capable of moving over the locking position without the movement of the inner body 3 being impeded by an unwanted engagement of the bolt 11 in the slotted part 16 due to fluctuations in hydraulic medium pressure and to leakage influences.

According to the invention, therefore, the hydraulic camshaft adjuster 1 has a bolt release position 11, which is largely independent of hydraulic medium pressure and of leakage. The basis of the invention is the hydraulically loadable mechanism 10 which includes the compression spring 2 acting axially on the bolt 11 and, additionally, a spring element 17 acting indirectly or directly radially on the bolt 11. A clearance 18 in the inner body 3 of the camshaft adjuster 1, which clearance is formed by the bolt guide opening 12, allows a radial displacement of the bolt 11 itself or of the bolt 11 arranged in the sleeve 13 out of the lockable position in relation to the guide slot 16 against the force of the radially acting spring element 17, into a no-lock position in relation to the guide slot 16, the spring element 17 having the lowest prestress in the locked state of the camshaft adjuster 1 and a maximum prestress in the released no-lock state of the camshaft adjuster 1 in which the bolt 11 is displaced radially in relation to the guide slot 16. In the present exemplary embodiment with the bolt 11 arranged in the sleeve 13, in the lockable radial position of the bolt 11 the spring 17 can be fixed in a clamping manner with some prestress between the sleeve 13 and a bearing surface in the inner body 3. In a version, not illustrated, without the sleeve 13, by contrast, in the lockable position of the bolt 11 with respect to the guide slot 16, the spring 17 must be fixed firmly to the inner body 3 and should exert no or only a slight clamping force on the bolt 11.

When the release pressure is applied, the bolt 11 is lifted out of the guide slot 16. As a result of the rotation of the camshaft adjuster 1 at an increased camshaft operating rotational speed beyond a specific minimum rotational speed, an additional outward displacement force is effective on the sleeve 13 together with the bolt 11 counter to the force of the radially acting spring element 17 because of the centrifugal force, so that the bolt is no longer fully in alignment with the guide slot 16 and consequently can no longer engage in the latter.

According to FIG. 4, a corresponding configuration of the guide slot 16 in the cover 5 allows a play-free locking position in the case of a low camshaft rotational speed when the effective centrifugal force on the hydraulically loadable mechanism 10 is lower than the counteracting radial spring force of the spring 17, for example during an engine start and also at the engine idling rotational speed. In this case, the cross section 16.1 of the guide slot 16 for receiving the bolt 11 narrows in the direction of a center of rotation, of the camshaft adjuster 1, so that the bolt 11 is pressed into the narrowing guide slot 16 by the radially acting spring element 17 and abuts in the guide slot 16 or in the cross section 16.1 circumferentially both sides and therefore is held free of play. The force of the spring element 17 ensures that the bolt 11 remains in a play-free position.

According to FIG. 5, the bolt 11 may also be biased into a play-free position with the assistance of a centrifugal force. For this purpose, the guide slot 16 is designed with a cross section 16.1 narrowing radially outward. Beyond a minimum rotational speed dependent on the spring force of the spring 17, for example when the engine is started with full throttle, the mechanism 10 is deflected radially, and the bolt 11 is biased into the guide slot 16 or in the opening 16.1 circumferentially at both sides. The centrifugal force holds the bolt 11 in firm contact and without play in position in the guide slot 16 or opening 16.1.

In order to combine the advantages of both embodiments according to FIGS. 4 and 5, it would be conceivable for the opening 16.1 of the guide slot 16 for receiving the bolt 11 to have a rhomboidal configuration.

What is claimed is:

1. A hydraulic camshaft adjuster (1) for a camshaft of an internal combustion engine, comprising an inner body (3) disposed in an outer body (4) forming a housing having side walls (5) connected fixedly for rotation with the camshaft and having at least one counter-vane (3.1), the outer body (4) being mounted rotatably with respect to the inner body (3) and having at least one vane structure(4.1, 4.2), which, between the two side walls (5), together forms at least one hydraulic fluid pressure chamber (9), said outer body (4) being driven by an engine crankshaft, and at least one hydraulically controlled locking mechanism (10) for selectively locking and releasing the inner body (3) with respect to the outer body (4), said locking mechanism comprising at least one bolt (11) guided in an opening (12) in the inner body (3) such that it can extend into a locking guide slot (16) in one of the two covers (5), an axially acting spring element (2) for biasing the bolt (11) toward the locking guide slot (16), said bolt being disengageable from the guide slot (16) counter to the force of the axially acting spring (2) by the pressure force of the hydraulic fluid, said hydraulically controlled mechanism (10) being designed in such a way that the bolt (11) has a release position in which the bolt is radially displaced out of alignment with the locking guide slot (16) which release position is largely independent of hydraulic fluid pressure and of hydraulic fluid leakage.

2. The hydraulic camshaft adjuster as claimed in claim 1, wherein the hydraulically controlled mechanism (10) includes a radially acting spring element (17) biasing the locking bolt (11) into a potential locking position and against which the locking bolt (11) is to be radially biased out of its potential locking position.

3. The hydraulic camshaft adjuster as claimed in claim 2, wherein the bolt (11) is guided in a sleeve (13).

4. The hydraulic camshaft adjuster as claimed in claim 3, wherein the guide opening (12) in the inner body (3) has a clearance (18) for the radial displacement of the bolt (11) or of the bolt (11) together with the sleeve (13).

5. The hydraulic camshaft adjuster as claimed in claim 4, wherein the radially acting spring element (17) is a leaf spring.

6. The hydraulic camshaft adjuster as claimed in claim 5, wherein the cross-section (16.1) of the guide slot (16) for receiving the bolt (11) narrows toward the center of rotation of the camshaft adjuster (1).

7. The hydraulic camshaft adjuster as claimed in claim 5, wherein the cross section (16.1) of the guide slot (16) for receiving the bolt (11) narrows radially outwardly.

8. The hydraulic camshaft adjuster as claimed in claim 5, wherein the cross section (16.1) of the guide slot (16) for receiving the bolt (11) narrows in the direction of a center of rotation of the camshaft adjuster (1) and also radially outward.

9. The hydraulic camshaft adjuster as claimed in claim 8, wherein the cross section (16.1) of the guide slot (16) for receiving the bolt (11) is of rhomboidal configuration.

10. A method for locking and releasing a hydraulic camshaft adjuster (1) for a camshaft of an internal combustion engine, said camshaft adjuster including a housing forming an outer body (4) having side covers (5) receiving therebetween an inner body (3) mounted rotatably with respect to the outer body (4) and having at least one hydraulic actuating mechanism (10) for locking and releasing the inner body (3) with respect to the outer body (4), with a locking bolt (11) axially movably mounted in the inner body (3) and being biased by an axially acting spring (2) into a guide slot (16) formed in one of the side covers (5), said locking bolt (11) being movable out of the guide slot (16) by hydraulic fluid pressure, and after being moved out of the guide slot (16) being displaced radially outwardly against the force of a radially acting spring element (17) and being held in such a non-lockable position by the centrifugal force of the camshaft adjuster (1) effective with an increased rotational speed of the housing.

11. The method as claimed in claim 10, wherein, after being moved out of the slot (16), the bolt (11) is pushed at least partially out of the area (16.1) of the guide slot (16) into a radial clearance area (18).

12. The method as claimed in claim 10, wherein, after being moved out of the slot (16), the bolt (11) is displaced radially outward beyond a specific minimum rotational speed of the camshaft adjuster (1).

13. The method as claimed in one of claims 10, wherein during the locking operation, below a minimum hydraulic medium pressure and a minimum rotational speed of the camshaft adjuster (1), the bolt (11) is moved into the guide slot (16) under the force of the axially acting spring element (2) and of the radially acting spring element (17).

14. The method as claimed in claim 10, wherein the locking position lies between the circumferential end positions of the vane (3.1) of the inner body (3) and the vanes (4.1, 4.2) of the outer body (4).

* * * * *